US005521358A

United States Patent [19]

Eilentropp

[11] Patent Number: 5,521,358

[45] Date of Patent: May 28, 1996

[54] ELECTRICAL HEATING CONDUCTOR

[76] Inventor: Heinz Eilentropp, Neyetal 22, Wipperfürth D51676, Germany

[21] Appl. No.: 189,437

[22] Filed: Jan. 31, 1994

[30] Foreign Application Priority Data

Feb. 1, 1993 [DE] Germany ..... 43 02 695.8

[51] Int. Cl.[6] ..... H05B 3/34; H01B 7/18

[52] U.S. Cl. ..... 219/549; 174/102 R

[58] Field of Search ..... 219/549, 505, 219/528, 203, 543, 301, 211; 428/383, 380; 525/420, 150; 528/125; 128/715; 524/600; 156/51, 53; 174/108, 102 R, 110 R, 120 SR, 110 N

[56] References Cited

U.S. PATENT DOCUMENTS

| | | | |
|---|---|---|---|
| 4,273,829 | 6/1981 | Perreault | 428/383 |
| 4,436,569 | 3/1984 | Weitzel et al. | 174/102 C |
| 4,521,485 | 6/1985 | Tondre et al. | 428/383 |
| 4,851,060 | 7/1989 | Wade Jr. et al. | 174/110 R |
| 5,138,684 | 8/1992 | Bullock et al. | 385/113 |
| 5,237,635 | 8/1993 | Lai | 174/110 R |
| 5,245,161 | 9/1993 | Okamoto | 219/549 |
| 5,374,782 | 12/1994 | Taylor et al. | 174/130 |

FOREIGN PATENT DOCUMENTS 1175784 4/1959 France .

*Primary Examiner*—Mark H. Paschall
*Assistant Examiner*—Sam Paik
*Attorney, Agent, or Firm*—Ralf H. Siegemund

[57] ABSTRACT

An electrical heating conductor having a resistance wire core and a high temperature-resisting, electrical insulation layer on top of the core, further having a multi-wire layer as a protective conductor, is improved by a layer of a wrapped foil made of a mechanically high strength material such as a polyimid or a polyether ketone or a derivative of either, and wrapped underneath or above the protective layer in order to protect the insulation layer against impacts and squeezing; the foil may be covered with a fluoropolymer coating for chemical protection; the multi wire layer includes a threaded-through high strength thread to hold the foil against the insulation underneath.

13 Claims, 1 Drawing Sheet

ELECTRICAL HEATING CONDUCTOR

BACKGROUND OF THE INVENTION

The present invention relates to an electric heating conductor having an electrically conductive core and a high temperature resisting, electrical insulation as well as an electric protective conductor configured as braided or stranded wire filaments.

German printed patent application (DE - OS) 28 50 722 describes a coaxial arrangement of a heating conductor with a fluoro-polymer as insulation. This heating conductor is provided for heating chemically aggressive fluids. The Fluoro polymer insulation is covered with a copper wire mesh whose individual wires are nickel plated to avoid corrosion. This wire mesh serves as the electric protective conductor. Particularly, this protective conductor is designed to avoid accidents that may result from short circuits within the heating conductor. The protective conductor is covered by an outer jacket made of a synthetic (e.g. a fluoropolymer) in order to provide protection against an aggressive fluid to which the heating conductor generally may be exposed or may accidentally become exposed. Such a coaxial configuration has the advantage of a wide field and range of use and employment owing to the temperature protective and corrosive fluid protections. In addition such a conductor is flexible throughout. Moreover this conductor can be manufactured in basically an endless fashion.

It was found however that occasionally, and owing to external operating conditions, a coaxial cable when subjected to strong external pressure has its outer jacket squeezed to such an extent that the insulation of the heating conductor is locally removed or at least dislodged such that the heating conductor proper and the protective conductor make physical contact or come to be placed in such a proximity that a glow or even a spark discharge obtains. In other cases of external force application, the wires of the protective conductor may break and pierce the insulation and make contact with the heating wire proper. that may actually lead to a complete failure of the heater.

The foregoing refers to factors and aspects which must be taken into consideration when designing electric heating equipment for use in explosion proof equipment and plants bearing in mind that precautionary protection against explosions poses specific as well as general design criteria in these instances. Criteria of this nature come also into play where the surface of the insulation must be covered by a protective conductor. Design criteria for assurance in this regard are given here e.g. by the German Industrial Standards (DIN) such as VDE 0170/0171. Testing of resistance against excessive squeezing followed by insulation testing is another aspect to be considered. Unfortunately it does not help to just make the insulation and the outer jacket thicker; by so doing, the problems may just become a little less frequent, but are not entirely eliminated. Aside from this consideration, making the various layers thicker increases the effective diameter and, due to the cost of the fluoropolymer, renders the cable more expensive.

DESCRIPTION OF THE INVENTION

It is an object of the present invention to provide a new and improved, and most importantly, sufficient protection of heating conductor insulation that can withstand the most severe impacts and squeeze forces that may act on the device.

It is a specific object of the invention to provide a new and improved electrical heating conductor having (i) an electrical insulation made of a high temperature resisting material, and (ii) an electrical protection conductor made e.g. of braided or stranded wire filaments that avoids the problems outlined above.

In accordance with the preferred embodiment of the invention, the objects and here particularly the specific object are attained by providing additionally and either above or below or both of the protective conductor one or more closed layers of a thin, ribbon—and foil—like wrap, hereinafter abbreviated as 'foil' made of a mechanical high strength synthetic material. This wrapping in any configuration provides local tensioning of the foil whenever impact or squeezing forces act upon the cable/conductor. In fact the foil may resiliently spring back when the force is removed. Placing the foil in a more outer region of the coaxial assembly results inherently in an increase in available and thus effective surface area particularly in comparison with the heating conductor proper. This means that for a given conductor length the amount of foil material that can take up shocks, impacts and squeezing is relatively large. Since ultimately it is the amount of material that determines the degree of afforded protection, this arrangement does indeed stop high pressures such as arising from impact. The danger of damage to the electrical insulation underneath is indeed impeded and to a great degree prevented.

The invention thus offers important advantages with regard to standardization and associated requirements for testing. For example, such a heating conductor has to take up a load of 1,500 Newtons for 30 seconds using a mandriel of 6 mm diameter. The springy retraction of the foil wrapping suffices to meet the standard requirements. Hence the conductor meets the required safety factor for explosion endangered plants. According to the invention the foil ribbon may be provided under the protective conductor. Should the protective conductor wires/filaments break then the foil prevents piercing into the insulation. While a double foil layering that is above and below the protective conductor is preferred from the point of view of overall safety, a single layer wrapping under the protective conductor may suffice and is of course more economical.

It is an essential feature that the ribbon foil is wrapped, that the material has a high mechanical strength and that the wrapping as a whole establishes a closed layer so that even point-like impacts at unforeseeable locations can be taken up in effect everywhere around the heating conductor proper. High strength materials that serve the needed purpose are for example Poly-imides and their derivatives. Alternatively poly-ether-ketone and its derivatives are also suitable for practicing the invention.

The foil itself may have one or two (opposite) surface layers made for example of a fluoro-polymer. Upon heating the foil or utilizing the heat content of the extruded—on jacket, a firm bond obtains between the several juxtaposed layers. As stated the protective conductor is a mesh of braided or stranded wire-filaments; the resulting mesh may be of a mixed nature; that is to say, it does not only include the metallic filaments but also synthetic fibers having a very high tensile strength. From an economic point of view it is better to strand the protective layer around the cable rather than to provide coveting through a pre-made mesh. Here, then, it was found to be advantageous to strand into the wires a high strength synthetic strand but with opposite pitch. This procedure of stranding actually fixes the assembly of stranded material (wires and synthetic fibers) on the surface of the electrical insulation. Moreover, these synthetic strands or fibers being stranded into the protective conductor assembly participate in the protective function of the foil or foils particularly when underneath the protective conductor in that these additional threads hold the foil wrapping onto the insulation. Still additionally, external mechanical forces acting transversely to the axis of the heating conductor assembly are kept away from the insulation; this is instrumental in avoiding damages and operational interference with the heater even when squeezing and/or impacts are very strong.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a heating conductor core 1 made of a plurality individual resistance heating filaments/wires. That conductor core is covered and enveloped by an insulation layer 2 made of a high temperature resisting material such as a fluoro-polymer. If suitable, the polymer is extruded onto the cable/conductor core. However, if the fluoro-polymer is a polytetrafluoro-ethylene, it is preferable to apply that material as a foil. That foil is applied, i.e. wrapped onto the core 1 in an unsintered state and subsequently it is sintered in situ. so that the individual ribbon—foil layers fuse (melt) to obtain a compact insulation.

Figure 1:
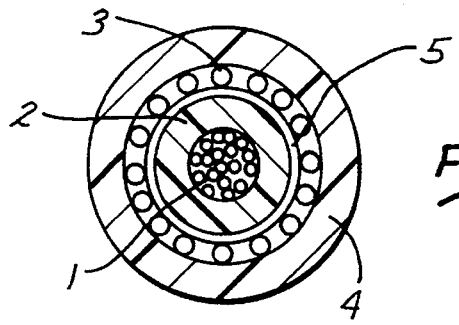
FIG. 1 is a cross-section through a heating conductor cable in accordance with the preferred embodiment of the invention for practicing a best mode thereof.

The illustrated concentric or coaxial configuration for this heating cable/conductor includes, furthermore, a protective conductor 3 and an outer jacket 4. If the heater is expected to be used in the chemical industry under conditions where exposure to aggressive chemicals is to be expected, then the jacket must be resistive to these chemicals. Often being flame retardant is another or additional requirement. Also, resisting to high temperature and generally favorable mechanical properties are additional requirements. Fluoropolymers are also suitable here. The jacket 4 may have been extruded onto the assembly or foils can be wrapped around the subassembly 1/2/3/(5). It is quite conceivable that the jacket is made of the same (foil—) material as the insulation 2. Of course this is not a requirement for practicing the invention, but may be an economic convenience factor.

Now, in order to make sure that the assembly as depicted and described thus far will not be damaged by forces acting in a radial direction and tending to impact and/or squeeze the assembly (i.e. will remain operational even if such forces are effective in a basically unforeseen manner), a foil cover 5 is provided as a wrapping around and on top of the insulation layer 2. This cover is comprised of one or several layers of closed wrapping. The wrapping is made of a mechanically very strong synthetic such as a polyimid. The specific location of interpositioning of this wrapping into the layer assembly of the heater assembly should be noted—that is, it is between the insulation 2 and the protective cover 3. This is the preferred way of proceeding for protecting the insulation by means of a sufficiently large area as offered by the layer 5. Layer and wrapping 5 takes up resiliently and actually elastically, radially acting forces. This way insulation 2 is protected against damage.

Figure 1A:
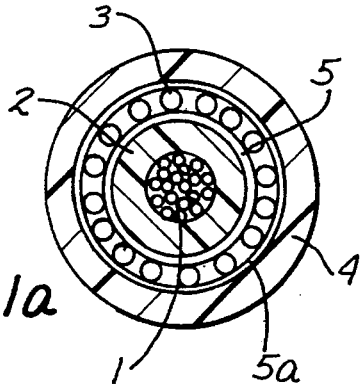
FIG. 1*a* is a view similar to FIG. 1 but of a modified version of the embodiment thereof.

FIG. 1*a* shows a modification according to which all parts and components 1,2, 3, 4, and 5 are as before, but now there is another layer and/or foil 5*a* provided in between the protective layer 3 and the outer jacket 4. Hence there are two protective layers such as foils 5 and 5*a*, and the protective conductor 3 is sandwiched in between. Still alternatively, layer 5 may be omitted so that there is only the outer foil layer 5*a*.

Figure 3:
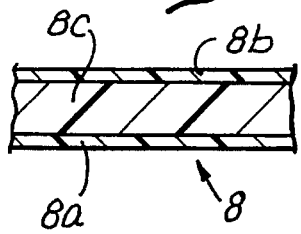
FIG. 3 is cross-section through a portion of a ribbon that can be used in the embodiment of FIG. 2.
Figure 2:
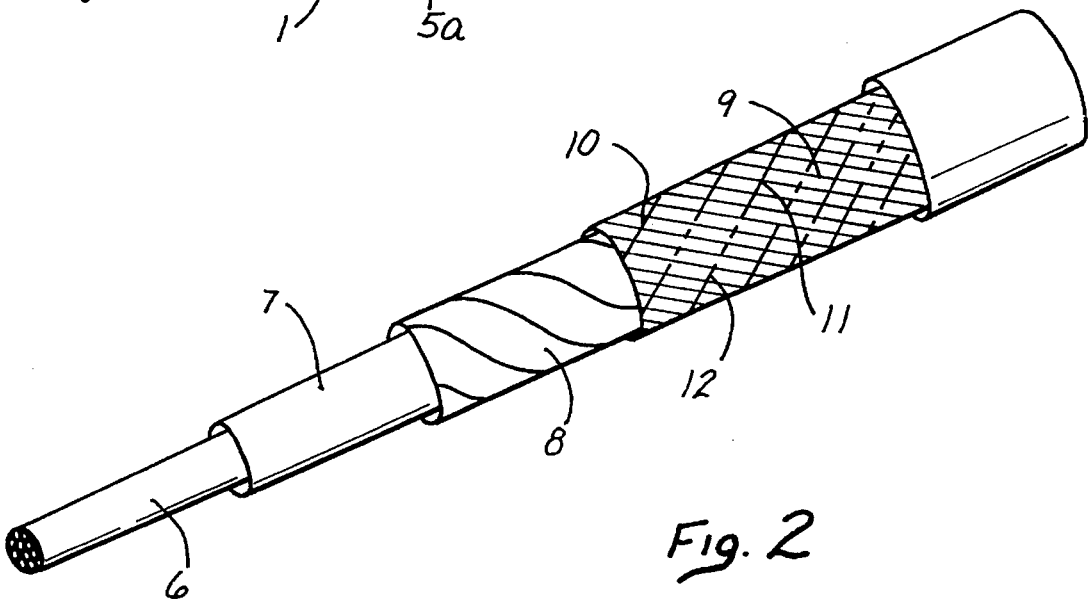
FIG. 2 is peeled away side and end/section view of a modified cable version in accordance with the preferred embodiment—best mode of the invention.

Turning now to FIG. 2, the assembly shown here is a variant of the one shown in FIG. 1 but still remains an example of the preferred embodiment. Reference numeral 6 refers here to the multi-filament heating conductor. Using multiple resistance wires enhances flexibility. This core assembly is covered by an insulation 7 made of a heat resisting synthetic preferably on the basis of fluor. Thus far the assembly is similar to the one illustrated in FIG. 1 and the materials involved for the insulation and the conductor/wire/filaments for the resistance heating are similar. Now in accordance with the specific feature a wrapping 8 is provided on top of insulation 7. A ribbon of foil material has been wrapped onto the assembly with overlapping edges to obtain a closed layer. The ribbon of which the layer 8 is made is a mechanically very strong synthetic (e.g. of the kind known in the trade under the TM Kapton). More generally, the ribbon 8 may be comprised of a central part 8*c* as shown in FIG. 3. That central part is made of a polyimide or of a derivative thereof or of a polyether-ketone or a derivative thereof. That central or inner part is coated with a fluoropolymer on one side (e.g. 8*a* or on both sides, 8*a* and 8*b*.)

On top of the wrapping 8 is provided a protective conductor made here of a plurality of threads or strands 9 that have been stranded around the assembly 6—7—8. This layer is comprised of a plurality of copper wires 9 being clad or otherwise coated with a metal for protecting the copper against corrosion. In addition, high tensile strength and temperature resisting strands 10 are braided into the copper wire strand assembly by being stranded into the copper-wire mesh at opposite pitch. The figure shows clearly that the threads 10 are placed above the wires 9 along length portions 11 while the gaps 12 indicate that the threads 10 thereat run under the wires 9—that is, in between the wires 9 and the wrapping 8. Braiding the threads 10 into the sets of wire 9 secures their position firmly on the layer 8. This is important as the wires 9 should not be displaced or otherwise dislodged upon bending of the assembly. Moreover, the threads as they are wrapped around the layer 8 fix also the latter and thus contribute to the protective aspect of the assembly as a whole as against impacts and squeezing, protecting particularly the insulation. The threads 10 are made of, for example, a polyaramid such as is known in the trade under the designation KEVLAR™. An outer jacket 14 is provided on top of the wire assembly 9. A foil such as 8 may also be interposed between the layer 9 and the jacket 14.

The invention is not limited to the embodiments described above but all changes and modifications thereof, not constituting departures from the spirit and scope of the invention, are intended to be included.

I claim:

1. Electrical heating conductor having a resistance wire core and a high temperature resisting, electrical insulation layer on top of the core, further having a multi-wire layer as a protective conductor, the improvement comprising;

a layer of a thin foil-like wrap made of a mechanically high strength material and being wrapped onto the insulation underneath the multi-wire layer in order to protect the insulation layer against impacts and squeezing.

2. Electric heating conductor as in claim 1, said foil being made of a polyimid or a derivative thereof.

3. Electric heating conductor as in claim 1, said foil being made of a polyether ketone or a derivative thereof.

4. Electric heating conductor as in claim 1, said foil being coated on at least one side with a chemical protection coating.

5. Electric heating conductor as in claim 4, said protection coating being a fluoropolymer.

6. Electric heating conductor as in claim 1, said protective layer including a high strength holding helix for the foil.

7. Electric heating conductor as in claim 6, said helix being strandingly included in the protective layer as made from a plurality of wires.

8. Electrical heating conductor having a resistance wire core and an high temperature-resisting electrical insulation layer on top of the core, further having a multi-wire layer as a protective conductor, the improvement comprising;

a layer of a thin foil-like wrap made of a mechanically high strength material and being wrapped onto the multi-wire layer in order to protect the insulation layer against impacts and squeezing.

9. Electric heating conductor as in claim 8, said foil being made of a polyimid or a derivative thereof.

10. Electric heating conductor as in claim 8, said foil being made of a polyether ketone or a derivative thereof.

11. Electric heating conductor as in claim 8, said foil being coated on at least one side with a chemical protection coating.

12. Electric heating conductor as in claim 11, said protection coating being a fluoropolymer.

13. Electric heating conductor as in claim 8, there being an additional foil wrapped around the insulation underneath the protective conductor for additionally protecting the insulation.

* * * * *